US012480737B2

(12) United States Patent
Pope

(10) Patent No.: US 12,480,737 B2
(45) Date of Patent: Nov. 25, 2025

(54) PORTABLE PNEUMATIC THROWLINE LAUNCHER

(71) Applicant: Michael Darren Pope, North Augusta, SC (US)

(72) Inventor: Michael Darren Pope, North Augusta, SC (US)

( * ) Notice: Subject to any disclaimer, the term of this patent is extended or adjusted under 35 U.S.C. 154(b) by 0 days.

(21) Appl. No.: 18/740,151

(22) Filed: Jun. 11, 2024

(65) Prior Publication Data

US 2025/0297827 A1 Sep. 25, 2025

Related U.S. Application Data

(60) Provisional application No. 63/569,420, filed on Mar. 25, 2024.

(51) Int. Cl.
*F41B 11/682* (2013.01)
*F41B 11/80* (2013.01)

(52) U.S. Cl.
CPC ..... *F41B 11/682* (2013.01); *F41B 11/80* (2013.01)

(58) Field of Classification Search
CPC ..... F41B 11/80; F41B 11/60; F41B 11/62; F41B 11/68; F41B 11/681; F41B 11/682; F42B 12/68
See application file for complete search history.

(56) References Cited

U.S. PATENT DOCUMENTS

| | | | | |
|---|---|---|---|---|
| 2,090,731 | A * | 8/1937 | Klein | F41B 11/68 43/6 |
| 3,142,293 | A * | 7/1964 | Harter | F41B 11/83 124/40 |
| 3,583,381 | A * | 6/1971 | Eaton | F41B 11/00 124/31 |
| 5,398,587 | A * | 3/1995 | Kornblith | F41F 1/00 102/504 |
| 7,063,623 | B2 * | 6/2006 | Wengert | F41B 11/57 124/16 |
| 8,613,275 | B1 * | 12/2013 | Ogg | A63B 69/40 124/78 |
| 9,080,832 | B2 * | 7/2015 | Brahler, II | F41H 13/0006 |
| 10,900,740 | B1 * | 1/2021 | Casto, Jr. | F41B 11/723 |
| 10,914,546 | B1 * | 2/2021 | Casto, Jr. | F41B 11/80 |
| 2005/0115548 | A1 * | 6/2005 | Wilson | F41B 11/57 124/56 |
| 2006/0283433 | A1 * | 12/2006 | Gerardo | F41B 11/62 124/75 |
| 2014/0331984 | A1 * | 11/2014 | Brahler, II | F41B 11/723 124/76 |

(Continued)

FOREIGN PATENT DOCUMENTS

| | | | | |
|---|---|---|---|---|
| DE | 4212623 | A1 * | 10/1993 | F04C 25/00 |
| JP | 06207797 | A * | 7/1994 | |

*Primary Examiner* — Joshua E Freeman
(74) *Attorney, Agent, or Firm* — Dunlap Bennett & Ludwig, PLLC

(57) ABSTRACT

A pneumatic throwline launcher has a barrel fluidly coupled to an air compressor and an air tank upstream of the air compressor that is also fluidly coupled to the air compressor. A battery electrically connected to the air compressor for selectively controlling power the air compressor, wherein the battery is physically connected to the air tank to enable portability of the pneumatic throwline launcher.

8 Claims, 4 Drawing Sheets

(56) References Cited

U.S. PATENT DOCUMENTS

| | | | | |
|---|---|---|---|---|
| 2015/0316345 | A1* | 11/2015 | Brahler, II | F41B 11/60<br>124/73 |
| 2017/0211906 | A1* | 7/2017 | Colby | F41B 11/723 |
| 2019/0107361 | A1* | 4/2019 | Salehi | F41B 11/681 |
| 2021/0108880 | A1* | 4/2021 | Dooley | F41B 11/62 |
| 2024/0077277 | A1* | 3/2024 | Schlosser | F41B 11/80 |
| 2024/0118052 | A1* | 4/2024 | Chen | F41B 11/73 |

* cited by examiner

PORTABLE PNEUMATIC THROWLINE LAUNCHER

CROSS-REFERENCE TO RELATED APPLICATION

This application claims the benefit of priority of U.S. provisional application No. 63/569,420, filed 25 Mar. 2024, the contents of which are herein incorporated by reference.

BACKGROUND OF THE INVENTION

The present invention relates to throwline launchers and, more particularly, to a portable throwline launcher.

A line thrower is a device that casts a line to a remote position. It is used in rescues as well as marine operations. Many current line throwers are pneumatically powered by compressed air or compressed inert gases. Pneumatic line throwers can be used for a variety of applications including replenishment at sea, ship to ship line deployment, ship to shoreline deployment, water rescue, high angle rescue, cable running in industrial applications, and tactical line deployment.

Pneumatic systems have three basic components: the launcher, a projectile, and the line. These systems are based on the creation of air pressure inside the launcher, which, when the air pressure is released, pushes the projectile with a forward momentum. There are no reverse blasts from the muzzle or projectile.

The exact delivery distance of the line thrower is largely determined by the combined weight of the projectile and line and by the amount of pressure and volume of compressed air. In general terms, the lighter the line, the farther the line can be deployed.

Current pneumatic line throwers, however, require auxiliary air supply, preventing the throwline launcher from being truly portable as movement of the throwline launcher is anchored by the requirement of the auxiliary air supply. This lack of portability in field operations is a big disadvantage in many of the deployment scenarios described above.

As can be seen, there is a need for a portable throwline launcher that enables an accurate throwline trajectory through providing a portable battery powered air compressor to fill the air tank of the launcher, thereby enabling the user to operate remotely by way of the portable shoulder-fired device that can be deployed to throw weighted line longer distances than the prior art with increased target accuracy.

SUMMARY OF THE INVENTION

In one aspect of the present invention, a pneumatic throwline launcher includes the following: a barrel fluidly coupled to an air compressor; an air tank fluidly coupled to the air compressor; and a battery electrically connected to the air compressor for selectively controlling power the air compressor, whereby the battery being physically connected to the air tank critically enables portability of the pneumatic throwline launcher.

In another aspect of the present invention, the pneumatic throwline launcher further includes the following: wherein the air tank is upstream of the air compressor, wherein the battery is directly connected to the air tank; further including a reel connected to the barrel; further including a handle directly connected to the air tank; further including a trigger directly connected to the air tank, wherein activation of the trigger delivers pressurized air from the air tank through the barrel, wherein the air compressor is configured to selectively pressurize the pressurized air in the air tank; further including an electrical connection between the battery to the air compressor, wherein the electrical connection is entirely external as it spans from the battery and the air compressor; and further including a line for operatively coupling the reel and a weighted projectile with a slot disposed therein.

These and other features, aspects and advantages of the present invention will become better understood with reference to the following drawings, description and claims.

DETAILED DESCRIPTION OF THE INVENTION

Figure 1:
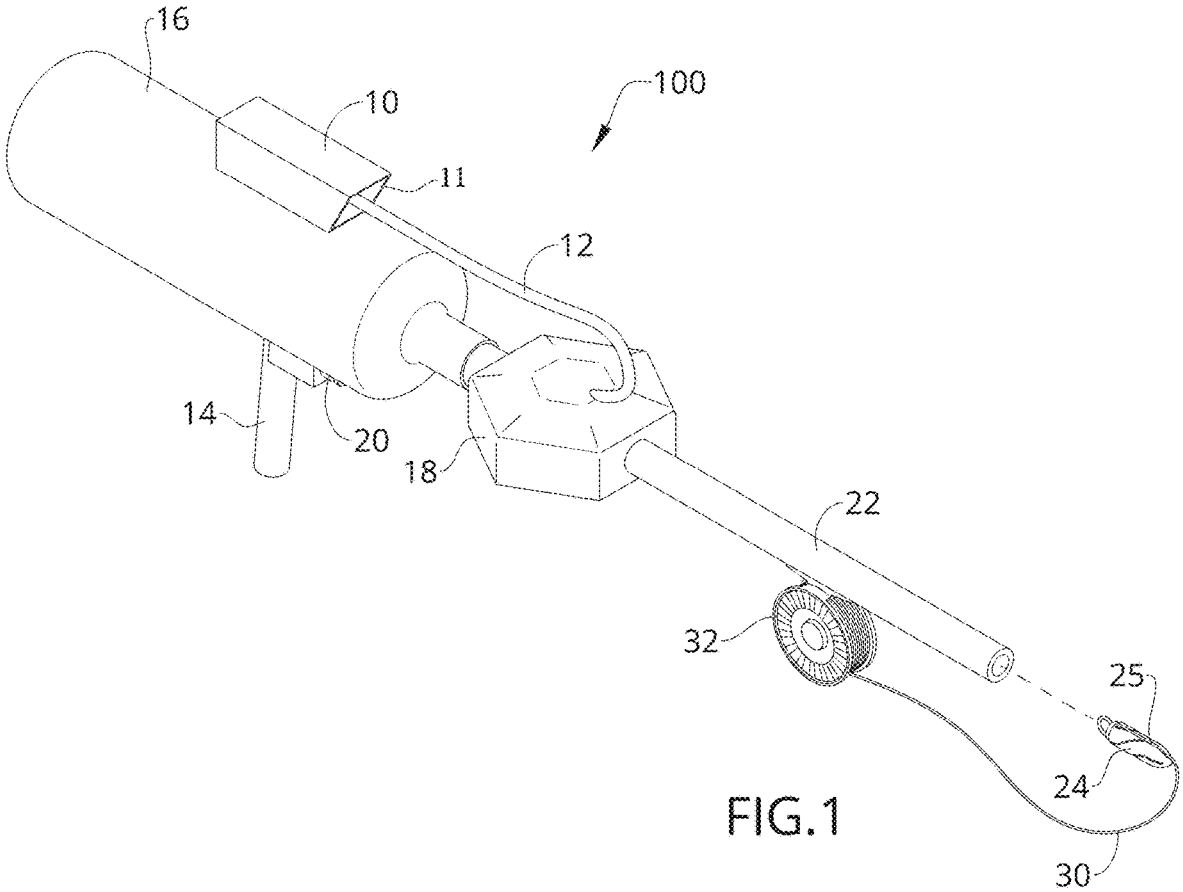
FIG. 1 is a perspective view of an exemplary embodiment of the present invention.
Figure 2:
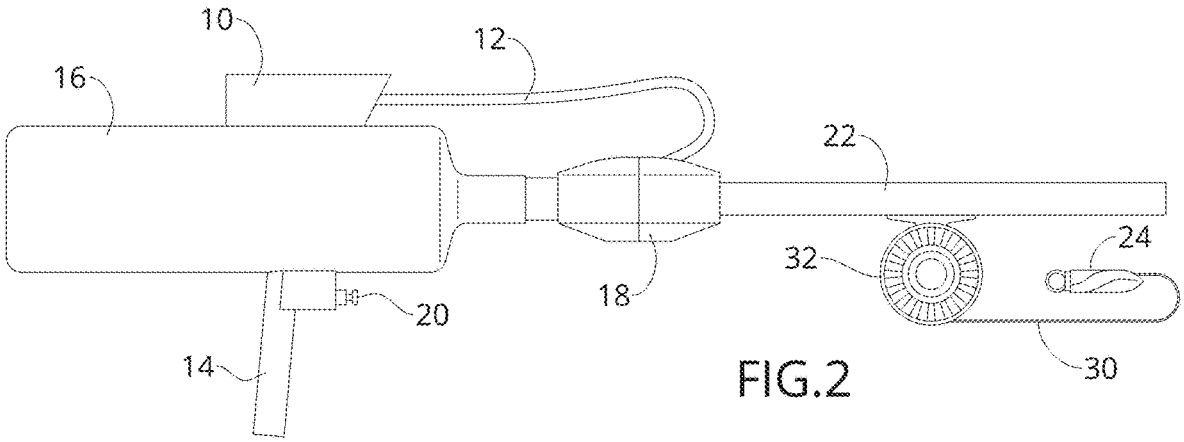
FIG. 2 is a side elevation view of an exemplary embodiment of the present invention.
Figure 3:
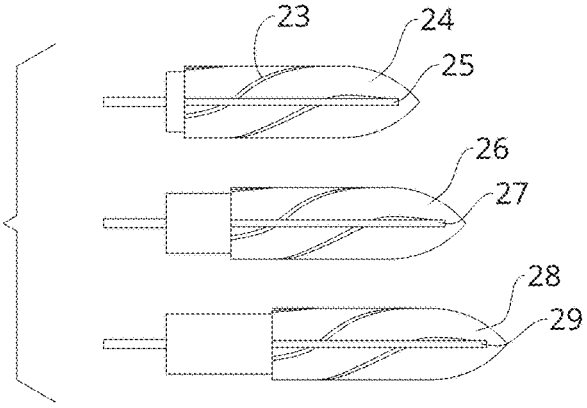
FIG. 3 is a plan or elevation view of an exemplary embodiment of the weights usable with the present invention.
Figure 4:
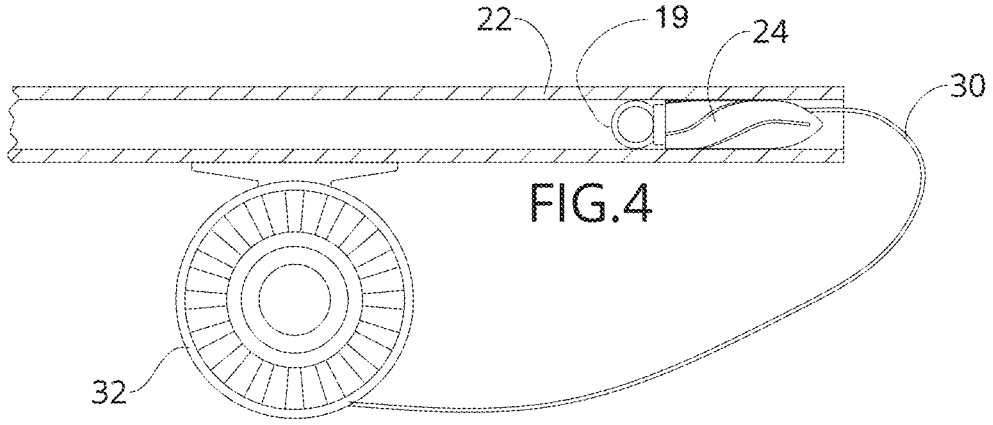
FIG. 4 is a section view of an exemplary embodiment of the present invention, illustrating a weighted projectile 24 being loaded in barrel 22, wherein the weighted projectile 24 is operatively associated with reel 32.
Figure 5:
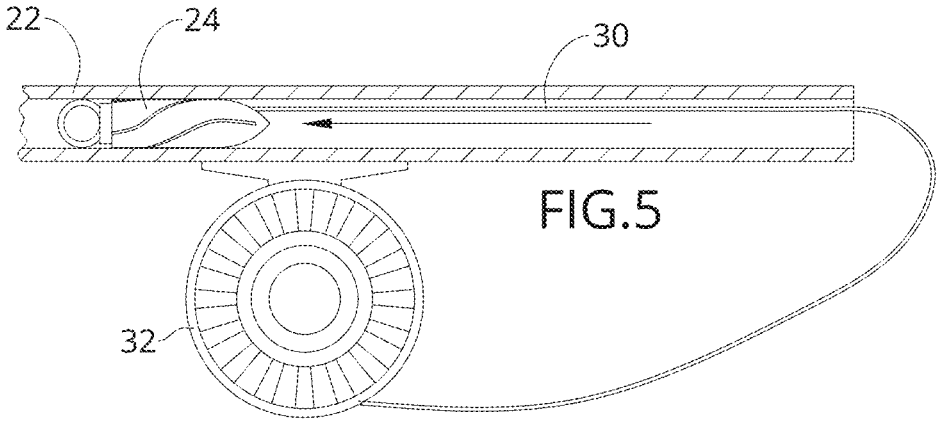
FIG. 5 is a section view of an exemplary embodiment of the present invention, illustrating the weighted projectile 24 operatively associated with reel 32 fully loaded in barrel 22.
Figure 6:
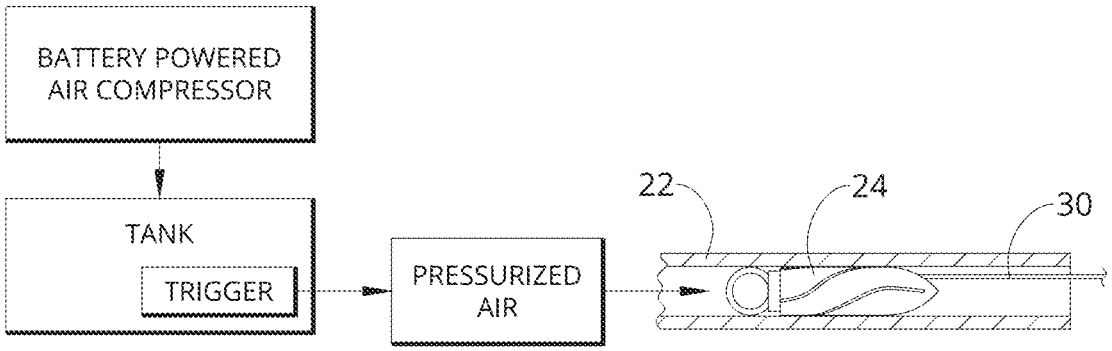
FIG. 6 is a detailed section view of an exemplary embodiment of the present invention, illustrating the weight operatively associated with reel 32 being shot.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a pneumatic throwline launcher having a barrel directly connected and directly fluidly coupled to a battery powered air compressor and an air tank upstream of the air compressor. A battery electrically connected to the air compressor selectively controls power to the air compressor, wherein the battery is physically connected to the air tank to enable portability of the pneumatic throwline launcher.

Referring to FIGS. 1 through 6, an embodiment of the present invention provides a portable pneumatic throwline launcher 100. The portable pneumatic throwline launcher 100 includes a launcher, one or a plurality of projectiles 24, 26, 28, and line 30.

The launcher includes a barrel 22 fluidly coupled to an air compressor 10. The air compressor 10 is fluidly coupled to an air tank 16 of compressed air. An electrical connection 12, such as an electrical cable or electrical wire, may connect the battery powered air compressor 10 to a pressure release valve 18. The air tank 16 may also provide a handle 14 adjacent a trigger 20. The trigger 20 may be provided with a trigger safety clip.

The battery powered air compressor 10 may be supported with compressor brackets 11. The battery powered air compressor 10 [8] may have a pressure gauge, tank fittings, a pressure release valve 18, and a bipod. As such, the battery powered air compressor 10 is configured to fill the air tank 16 to a preset pressure so that when the trigger 20 is activated, the air tank 16 delivers the pressurized air through the barrel 22, propelling the throw weighted projectile 24, 26, or 28 along a user defined trajectory.

Each weighted projectile 24, 26, 28 may provide a connection slot or point 25, 27, 29, respectively, for operatively associating with the line 30. Each weighted projectile 24, 26, 28 may provide a hook or connector 19 on its rear end to attach a throw line 30. Each weighted projectile 24, 26, 28 may have a stainless steel or aluminum core. The exterior may be a durable silicone rubber and have spiral grooves 23 enabling the weighted projectile to maintain a more straight-line trajectory because the passage of air through the spiral grooves 23 causes aerodynamic spinning. The weighted projectile 24, 26, 28 may be weighted to 5 oz, 10 oz, 12 oz and 16 oz. The weighted projectile 24, 26, 28 may include a strobe light that can be turned on and used during night-time operations for easy visual. The weighted projectile 24, 26, 28 may be various sizes, including but not limited to 37 millimeters (mm).

Line 30 may be wrapped, pre-launch, around the spool of a reel 32 so that each projectile 24, 26, or 28 can be reeled back. Line 30 may be cord or other rope constructed with an interior core protected by a woven exterior sheath designed to optimize strength, durability, and flexibility. The reel 32 may be a 12" diameter fast deployment throwline launcher reel. with 3:1 gearing, enabling the line 30 to be wound onto the reel 32 very quickly into three connected sections to prevent tangling. When ready for line deployment the reel 32 may be tilted to a 45-degree angle and the line 30 pulled from the open end of the reel 32 at velocity by the throw weight.

Figure 7:
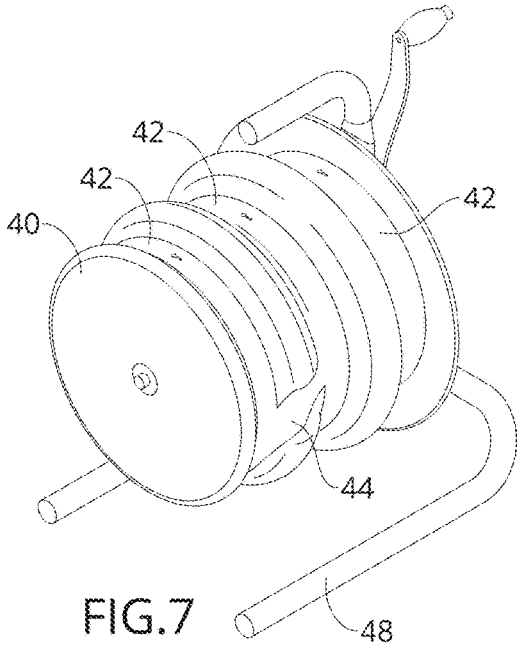
FIG. 7 is a top front perspective view of an exemplary embodiment of a wire wheel of the present invention.
Figure 8:
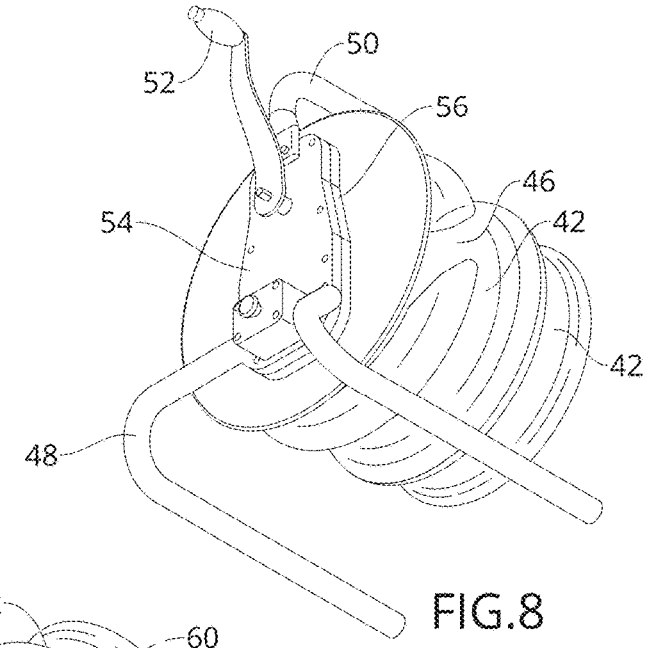
FIG. 8 is a bottom rear perspective view of an exemplary embodiment of the wire wheel of the present invention.
Figure 9:
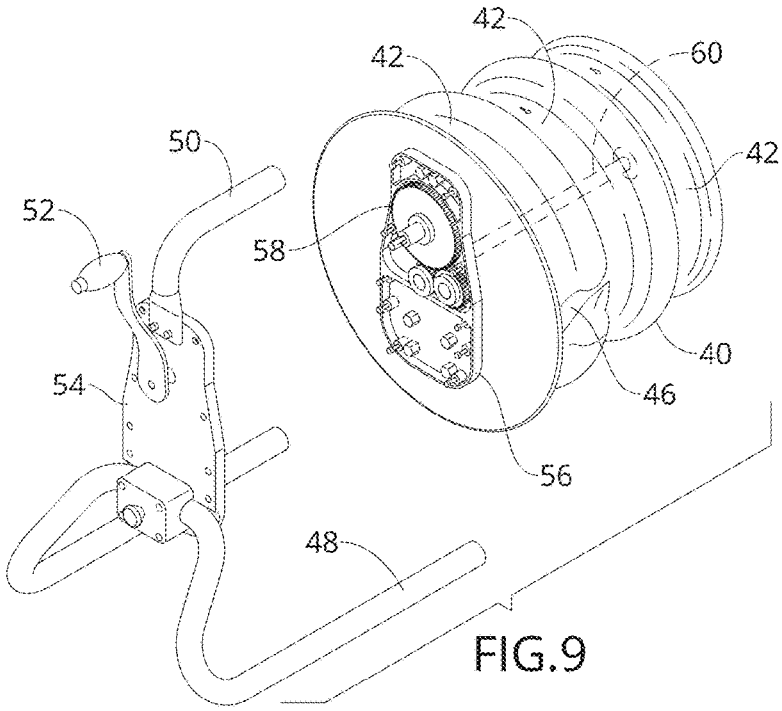
FIG. 9 is an exploded top rear perspective view of an exemplary embodiment of the wire wheel of the present invention.

Referring to FIG. 7 through, the present invention may provide a crank assembly providing a carrying handle 50, crank handle 52, and stand 54 that operatively associates with a tumbler 40 for facilitating reeling back line 30 after firing one or the weighted projectiles 24, 26, 28. The tumbler 40 may have concentric threads and grooves defining tumble slots 42 with guide slots 44 and 46 to engage with the line 30 with the tumbler 40. The crank assembly may have a first gear element 54 that operatively associates with a second gear element 54 of the tumbler 40. The second gear element 54 of the tumbler 40 is rotatably coupled to the tumbler 40 by way of a crank shaft 60 which is coupled to the crank handle 52 by way of a gear assembly 58 housed in the second gear element 56. The crank handle 52 and carrying handle 50 and first gear element 54 are supported by bipod feet 48. components of the crank assembly may be composed of plasticized, metallic or combination of such materials.

The present invention can be made by assembling all or part of the components listed above, whereby the battery powered compressor 10 is critical to making the pneumatic throwline launcher 100 portable.

During operation, a user estimates the range of a target, sets a desired commensurate air pressure on the battery powered compressor 10, and then starts the battery powered compressor 10, if necessary. The user then inserts a seal cup into the barrel 22, and then loads a throw weighted projectile 24, 26, 28 into the barrel 22 allowing the weighted projectile 24, 26, 28 to bottom out (when it reaches the bottom end of the barrel). Then the user may take aim at a target, remove the safety clip, and depress trigger 20 to deploy the throw weighed line into the air at desired trajectory.

Accordingly, the present invention may be used in many operational theaters, including fire rescue, tree care services, tree removal services, maritime operations, rock climbing, rope climbing, suspension bridge building, zip lining, and the like.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A pneumatic throwline launcher comprising:

a barrel fluidly coupled to an air compressor;

an air tank fluidly coupled to the air compressor;

a pressure release valve fluidly coupled to the barrel and the air tank;

a battery electrically connected to the air compressor for selectively controlling power to the air compressor;

a compressor bracket physically connecting the air compressor to the air tank;

an electrical connection extending between the air compressor to the pressure release valve, wherein the electrical connection is entirely external as it spans from the air compressor to the pressure release valve so as to not contact the compressor bracket, whereby the battery being physically connected to the air tank enables portability of the pneumatic throwline launcher.

2. The pneumatic throwline launcher of claim 1, wherein the air tank is upstream of the air compressor.

3. The pneumatic throwline launcher of claim 2, further comprising a reel connected to the barrel.

4. The pneumatic throwline launcher of claim 3, further comprising a handle directly connected to the air tank.

5. The pneumatic throwline launcher of claim 4, further comprising a trigger directly connected to the air tank.

6. The pneumatic throwline launcher of claim 5, wherein activation of the trigger delivers pressurized air from the air tank through the barrel.

7. The pneumatic throwline launcher of claim 6, wherein the air compressor is configured to selectively pressurize the pressurized air in the air tank.

8. The pneumatic throwline launcher of claim 7, further comprising a line for operatively coupling the reel and a weighted projectile with a slot disposed therein.

* * * * *